US005701867A

United States Patent [19]

Mizutani et al.

[11] Patent Number: 5,701,867

[45] Date of Patent: Dec. 30, 1997

[54] APPARATUS FOR CONTROLLING THE SPEED OF AN ENGINE

[75] Inventors: Kouichi Mizutani, Seto; Takehiko Tanaka; Kenya Maruyama, both of Toyota; Masanori Senda, Nagoya; Katsunao Takeuchi, Aichi-ken; Toru Sato, Chita, all of Japan

[73] Assignee: Toyota Jidoshi Kabushiki Kaisha, Toyota, Japan

[21] Appl. No.: 659,968

[22] Filed: Jun. 3, 1996

[30] Foreign Application Priority Data

Jun. 14, 1995 [JP] Japan ..... 7-147867

[51] Int. Cl.[6] ..... F02D 41/16

[52] U.S. Cl. ..... 123/339.16; 123/339.23

[58] Field of Search ..... 123/339.16, 339.17, 123/339.18, 339.19, 339.23

[56] References Cited

U.S. PATENT DOCUMENTS

| | | | |
|---|---|---|---|
| 4,638,778 | 1/1987 | Kamei et al. | 123/339.2 |
| 4,883,034 | 11/1989 | Yashiki et al. | 123/339.19 X |
| 5,136,997 | 8/1992 | Takahashi et al. | 123/339.21 |
| 5,261,368 | 11/1993 | Umemoto | 123/339.23 X |
| 5,265,571 | 11/1993 | Sudeno | 123/339.17 |

FOREIGN PATENT DOCUMENTS

| | | |
|---|---|---|
| 60-19932 | 2/1985 | Japan . |
| 60-19934 | 2/1985 | Japan . |
| 60-19937 | 2/1985 | Japan . |
| 61-25941 | 2/1986 | Japan . |

*Primary Examiner*—Tony M. Argenbright
*Attorney, Agent, or Firm*—Oliff & Berridge, P.L.C.

[57] ABSTRACT

An apparatus for controlling the idling speed of an engine is disclosed. An idling speed control valve disposed in an idle passage communicates with the intake passage downstream and upstream of the throttle valve to control the amount of the airflow supplied to the idling engine. A neutral start switch outputs an instruction signal to an ECU based on a switching operation of a shift lever from its neutral range to a drive range. Based on the instruction signal, the ECU computes a duty factor to increase the airflow amount through the idle speed control valve to a predetermined amount. The increased airflow amount is subsequently attenuated to a predetermined magnitude with an attenuation factor based on a change rate of the engine speed.

27 Claims, 8 Drawing Sheets

APPARATUS FOR CONTROLLING THE SPEED OF AN ENGINE

BACKGROUND OF THE INVENTION

1. Field of the Invention

This invention relates generally to an apparatus for controlling engine speed. More particularly, the present invention pertains to an apparatus for a stable change of engine speed when the engine is idling.

2. Description of the Related Art

There has been an increasing demand for improving automobile gas mileage. One of the attempted measures to improve the mileage is to lower the engine idle speed when the automobile is at rest.

In an automobile having an automatic transmission, the engine receives load when the transmission shift lever is shifted from the neutral range into the drive range. As illustrated with the chain line in FIG. 10, this load often causes the abrupt drop of the engine speed. In other words, the switching operation of the shift lever makes the engine speed unstable when the engine is idling.

The Japanese Unexamined Patent Publication No. 60-19932, in the name of the present assignee, discloses an apparatus for coping with the above deficiency. In this apparatus, the air-fuel mixture is increased in order to compensate for the lowered engine speed due to the shifting of the shift lever. More specifically, as shown in FIG. 10, an idle speed control valve (ISCV) is arranged in a bypass passage to control airflow passing therethrough. In the passage, an aperture of the ISCV is increased to a predetermined degree when the shift lever is switched. This increases the amount of air to be mixed with the fuel. Subsequently, the airflow through the bypass is decreased to a predetermined level by gradually narrowing the aperture of the ISCV when the engine is free of the load.

In this apparatus, the rate of narrowing the ISCV increases as the initial engine speed increases. The main purpose of the apparatus focuses on how to prevent undershoot of the engine speed and on how to decrease the engine speed smoothly to the predetermined level by a temporal application of the above described control. The rate of narrowing the ISCV is regulated regardless of differences among individual engines and is regulated according to the initial engine speed. The engine receives a drag torque from a transmission member mechanically connected thereto. However, the magnitude of this torque depends on the mechanical condition of each transmission member. Accordingly, the engine load affected by the torque varies from engine to engine. This control operation, which disregards the differences of the load acting on individual engines, often causes an excessive drop in the engine speed, resulting in stalling and undershoot.

Furthermore, when the load of the automatic transmission is great (for example, when the oil temperature is low and/or its viscosity is high), the initial engine speed stays relatively low. In this case, the aperture of the ISCV narrows too quickly when the engine becomes free of the load. This causes an abrupt drop of the amount of air flowing through the bypass passage. The resultant sudden drop of engine speed causes stalling and undershoot.

SUMMARY OF THE INVENTION

It is an object of present invention to provide an apparatus for controlling an engine idling speed smoothly regardless change of load applied to the engine.

To achieve the above object, an improved apparatus is disclosed. The apparatus for controls the speed of an engine, wherein airflow is supplied to the engine through an air passage means. The apparatus comprises valve means located in the air passage means to control the airflow to the engine, detecting means for detecting an engine condition, control means for controlling the airflow amount through the valve means, said control means including computing means for computing a target airflow amount of the valve means based on the detected engine condition and determining means for determining an application of the load to the engine in accordance with the detected load, said control means being arranged to operate according to at least a first mode and a second mode, said first mode being selected when the engine is running, said second mode being selected when the engine is idling, said first mode being programmed to converge the airflow amount through the valve means to the target airflow amount and said second mode being programmed to increase the airflow amount through the control valve to a predetermined degree based on the application of the load to the engine, said increased amount of the airflow being attenuated to a predetermined magnitude at a rate that is determined based on a rate of change of the engine speed.

BRIEF DESCRIPTION OF DRAWINGS

The invention, together objects and advantages thereof, may best be understood by reference to the following description of the presently preferred embodiments together with the accompanying drawings in which.

DETAILED DESCRIPTION OF THE PREFERRED EMBODIMENTS (First Embodiment)

The first embodiment of an apparatus for controlling engine speed according to the present invention will be now described with reference to FIGS. 2 through 6.

Figure 2:
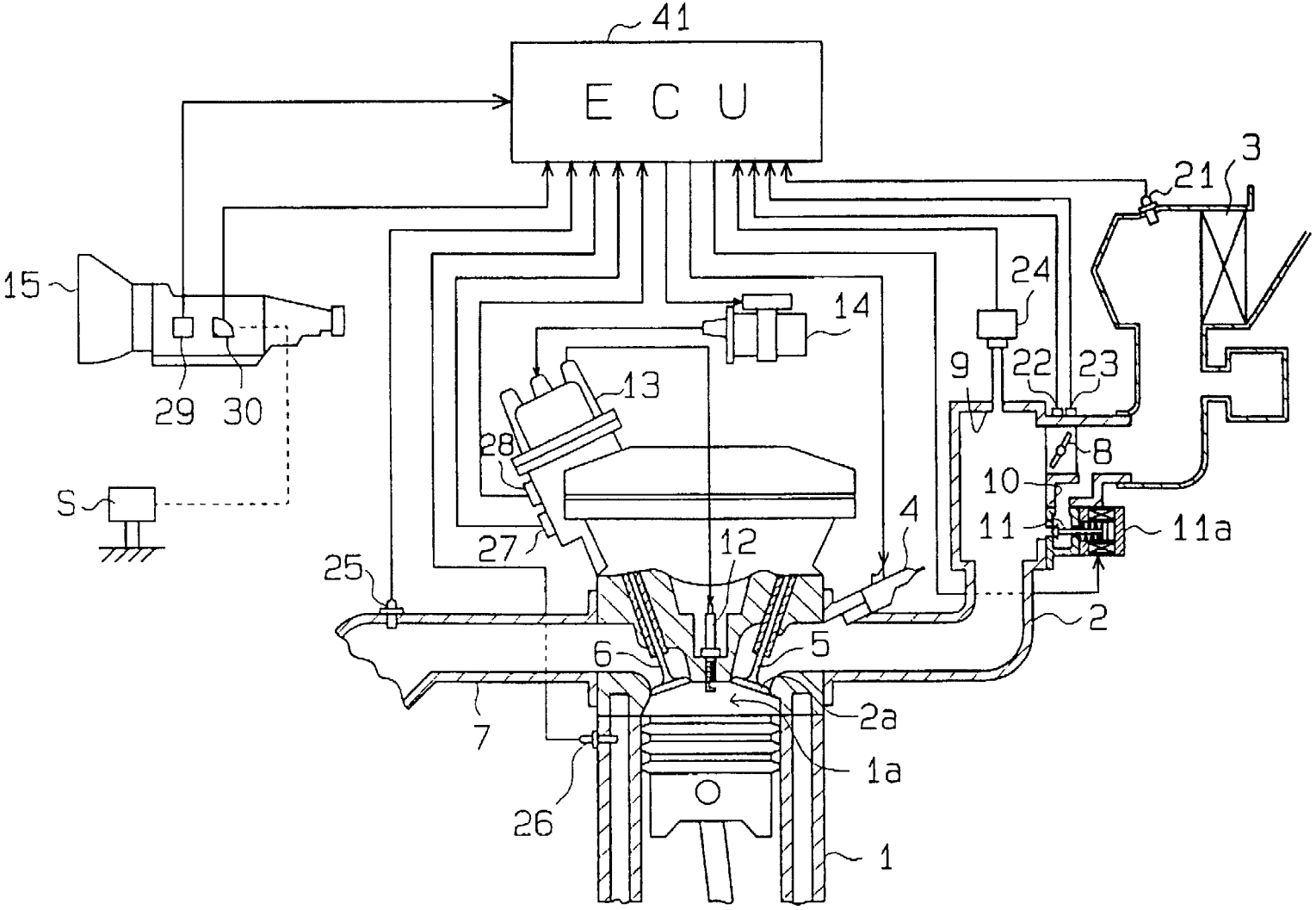
FIG. 2 is a schematic illustration showing an apparatus for the controlling the speed of an engine according to the first embodiment of the present invention.

FIG. 2 shows an apparatus for controlling the speed of an engine 1 mounted on an automobile. After passing through an air cleaner 3, the outside air is drawn into an intake pipe 2, which communicates with the engine 1. An injector 4 provided in each cylinder injects fuel in the vicinity of an intake port 2*a*. The injected fuel is mixed with the outside air. The engine 1 has a plurality of combustion chambers 1*a*. The air-fuel mixture is drawn into each combustion chamber 1*a* via an intake valve 5 provided in each cylinder. Then the air-fuel mixture is burned to produce the driving power of the engine 1. The burning of the air-fuel mixture generates exhaust gas. The exhaust gas is drawn from an exhaust valve 6 of each combustion chamber 1*a* to the corresponding exhaust manifold. Then the exhaust gas is drawn to an exhaust pipe 7, which is a convergence of the exhaust manifolds, to be discharged outside.

A throttle valve 8 is provided in the intake pipe 2. The throttle valve 8 opens and closes in accordance with movement of a gas pedal (not shown) connected thereto. The amount of air drawn to the intake pipe 2 is controlled by opening and closing the throttle valve 8. The speed of the engine 1 increases as the throttle valve 8 is opened wider. The throttle valve 8 is closed when the engine 1 is idling. A surge tank 9 smoothens the pulsing stream of the airflow passing through the throttle valve 8.

The intake pipe 2 has a bypass 10. The bypass 10 provides a detour around the throttle valve 8, as shown in FIG. 2. The airflow in the bypass 10 is controlled by an idle speed control valve (herein after referred as ISCV) 11 provided therein. The ISCV 11 has a solenoid 11*a*. The solenoid 11*a* is activated in accordance with the duty factor that decides an opening period of the ISCV 11 when the throttle 8 is closed, i.e., when the engine 1 is idling. The airflow (the amount of aspirated air) through the bypass 10 depends on the period of the opening of the ISCV. The engine speed NE is controlled by adjusting the amount of aspirated air.

The temperature of the airflow (THA) through the intake pipe 2 is detected by an intake temperature sensor 21 provided in the vicinity of the air cleaner 3. The opening position θ of the throttle valve 8 is measured by a throttle sensor 22. A complete closure of the throttle valve 8 activates an idle switch 23. Accordingly, the idle switch 23 detects that the engine starts idling. An aspiration pressure sensor 24, which communicates with the surge tank 9, measures the intake pressure PiM.

An oxygen sensor 25 provided in the exhaust pipe 7 measures the oxygen content OX in the exhaust gas. A cooling water temperature sensor 26 measures the temperature of the cooling water THW (cooling water temperature) in the engine 1.

Each cylinder of the engine 1 has an ignition plug 12. Each ignition plug 12 receives ignition signals distributed by a distributor 13. The distributor 13 distributes high voltage outputed from an igniter 14 to each ignition plug 12 in accordance with the speed of the engine 1. The ignition timing of the ignition plug 12 is determined by the output timing of the high voltage from the igniter 14.

The distributor 13 has a rotor (not shown) therein. The distributor 13 further has an engine speed sensor (rotation sensor) 27 and a crank position sensor 28. The engine speed sensor 27 detects the engine speed NE by counting the number of revolution of the rotor. The crank position sensor 28 detects changes of the angle of the crankshaft in the engine 1.

An automatic transmission 15 is connected to the engine 1. The automatic transmission 15 has an automobile speed sensor 29. The automobile speed sensor 29 detects the speed of the automobile SPD at each moment and outputs signals having the value of the speed. The automatic transmission 15 has a neutral start switch 30. The neutral start switch 30 detects whether the current position ShP the shift lever S is in the neutral range (including the parking range). In other words, the neutral start switch 30 is able to detect whether the position ShP of a shift lever S is in the neutral range or the drive range. The automatic transmission 15, together with the air conditioner (not shown), the head lamps and so forth contribute to the external load.

The driving condition of the engine 1 is detected by the sensors 21, 22, 24 to 29, the idle switch 23, the neutral start switch 30 and so forth.

Figure 3:
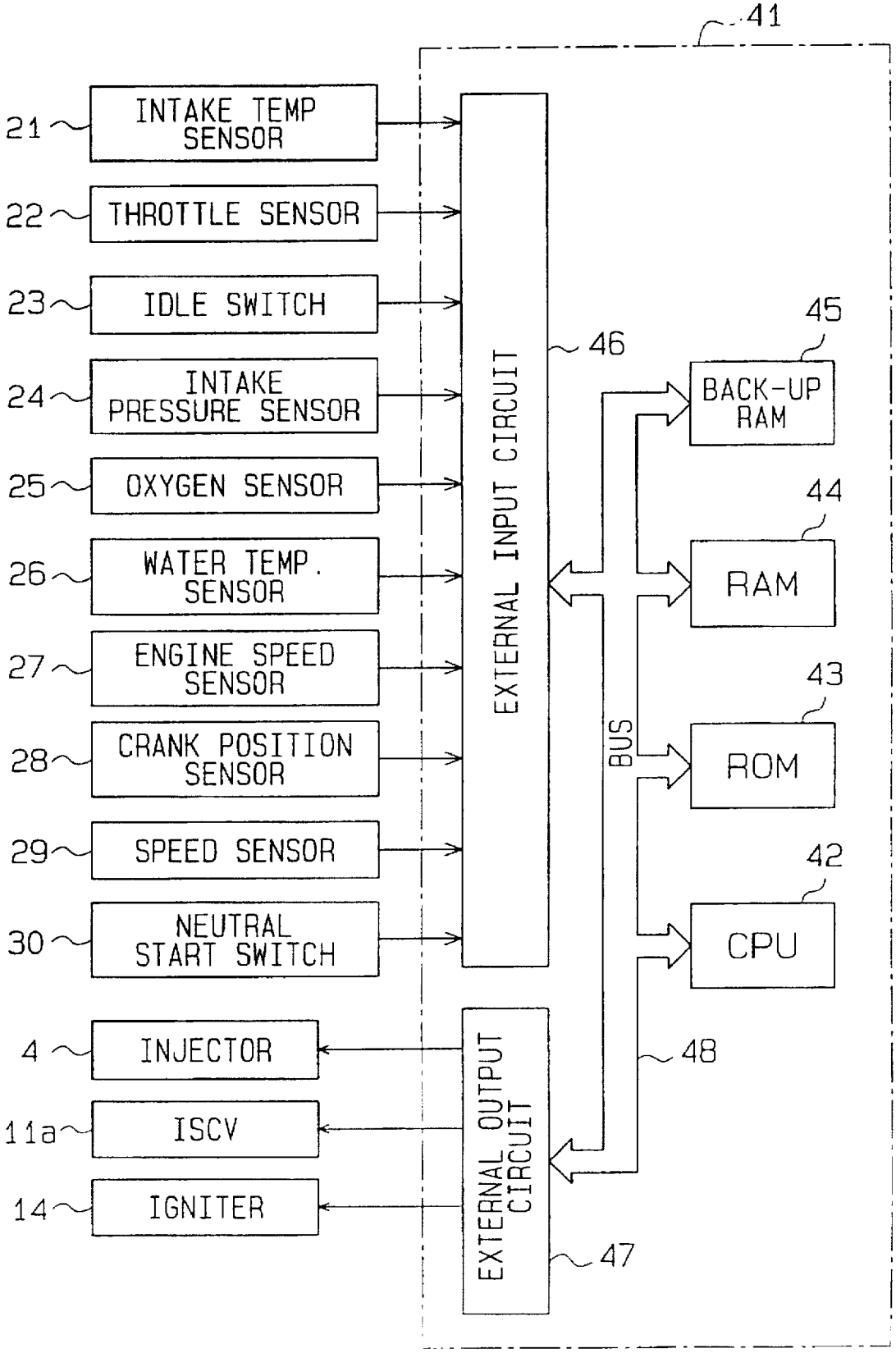
FIG. 3 is a block diagram showing the electric structure of an ECU according to the first embodiment of the present invention.

As shown in FIG. 3, an electric control unit (ECU) 41 includes a CPU 42, a ROM 43 having prescribed control programs and maps previously recorded therein, a RAM 44 for temporarily storing the computation result of the CPU 42 and a backup RAM 45 storing previously recorded data. The ECU 41 is a logic operation circuit in which the parts 42 to 45, an external input circuit 46 and an external output circuit 47 are connected to each other via a bus 48.

Connected to the external input circuit 46 are the aspiration temperature sensor 21, the throttle sensor 22, the idle switch 23, the aspiration pressure sensor 24, the oxygen sensor 25, the cooling water temperature sensor 26, the rotation sensor 27, the crank position sensor 28, the automobile speed sensor 29 and the neutral start switch 30. The CPU 42 receives signals from the sensors 21, 22, 24 to 29, the idle switch 23 and the neutral start switch 30 via the external input circuit 46. Based on the signals, the CPU 42 controls the injector 4, solenoid 11a and the igniter 14, which are connected to the external output circuit 47 respectively. Learned values and flags are stored in the backup RAM 45.

Among various processes executed by the ECU 41, the control of the opening of the ISCV 11 will now be described. The ECU 41 monitors the current state of the engine 1 based on the signals from sensors 21 to 30 and renews the target period of the opening of the ISCV 11 as needed. The target period indicates the target speed of the engine 1.

Figure 1:
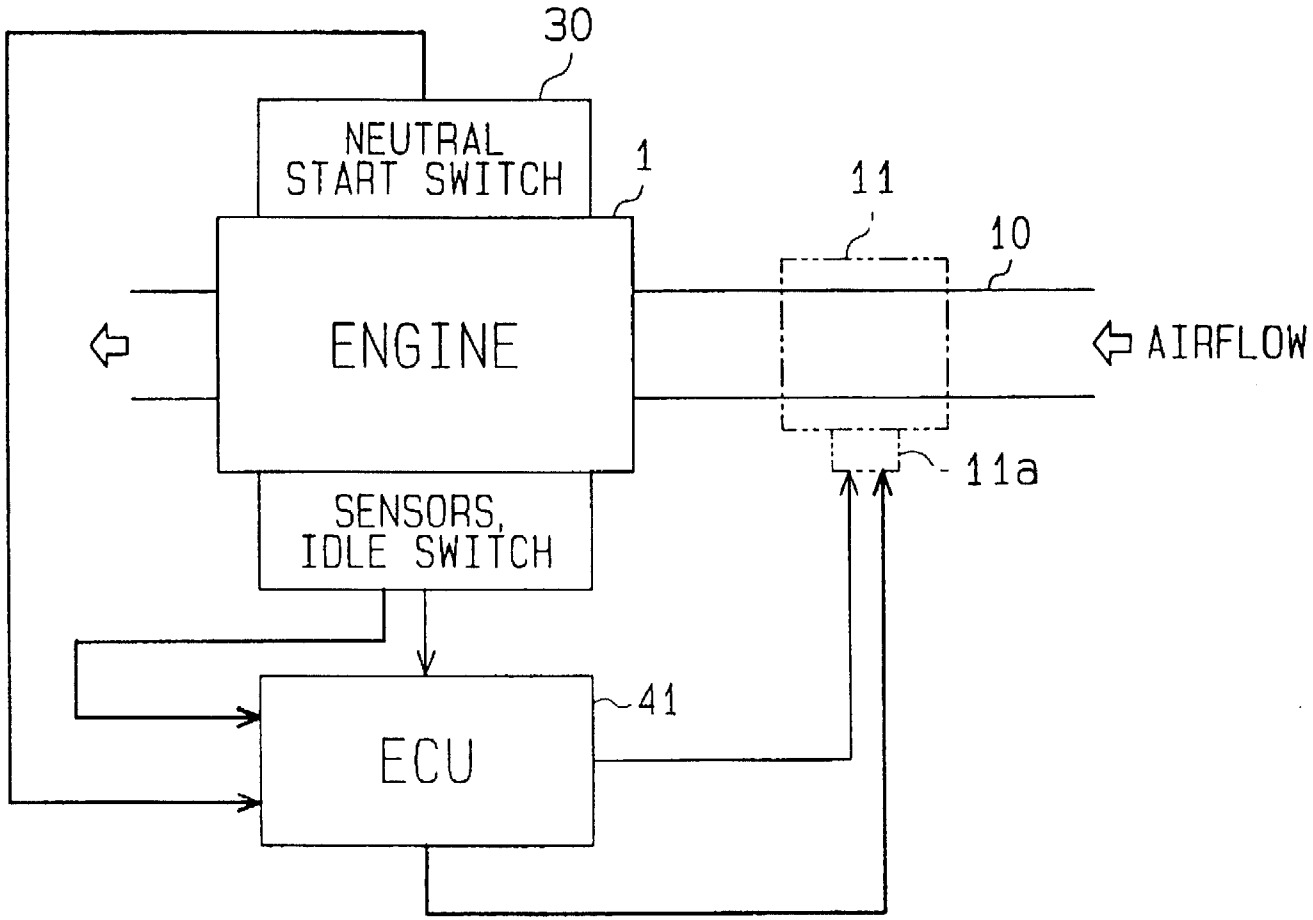
FIG. 1 is a schematic block diagram for explaining the concept of the present invention.

The ECU 41 operates based on one of the following three control modes: N-range mode, D-range mode and range switch mode. More specifically, the ECU 41 periodically shifts to a subroutine from main routine when the engine 1 is idling. In the subroutine, the ECU 41 monitors the position ShP of the shift lever S based on signals from the neutral switch 30. When the shift lever position ShP is in the neutral range, the ECU 41 operates in the N-range mode and computes a duty factor for the N-range NDUTY. Then the ECU 41 controls the opening of the ISCV 11 based on the duty factor NDUTY. When both a previous and a current reading of data indicate that the shift lever position ShP is in the drive range, the ECU 41 operates in the D-range mode and computes a duty factor for the D-range DDUTY. The ECU then controls the period of the opening of the ISCV 11 based on the duty factor DDUTY. When the shift lever position ShP changes from the neutral range to the drive range, the ECU 41 operates in the switch mode and subtracts an attenuation value from the duty factor. The ECU then controls the period of the opening of the ISCV 11 based on the newly obtained duty factor. The ECU 41 executes a closed loop control (shown with a thick line in FIG. 1) in the N-range mode and D-range mode and executes an open loop control (shown with a normal line) in the switch mode.

The backup RAM 45 has an open loop control flag for idling FOPEN. The ECU 41 set the value of the flag FOPEN "1" when it starts operating in the switch mode. The ECU 41 sets the value of the flag FOPEN "0" when it starts operating in the N-range mode or the D-range mode.

Figure 4:
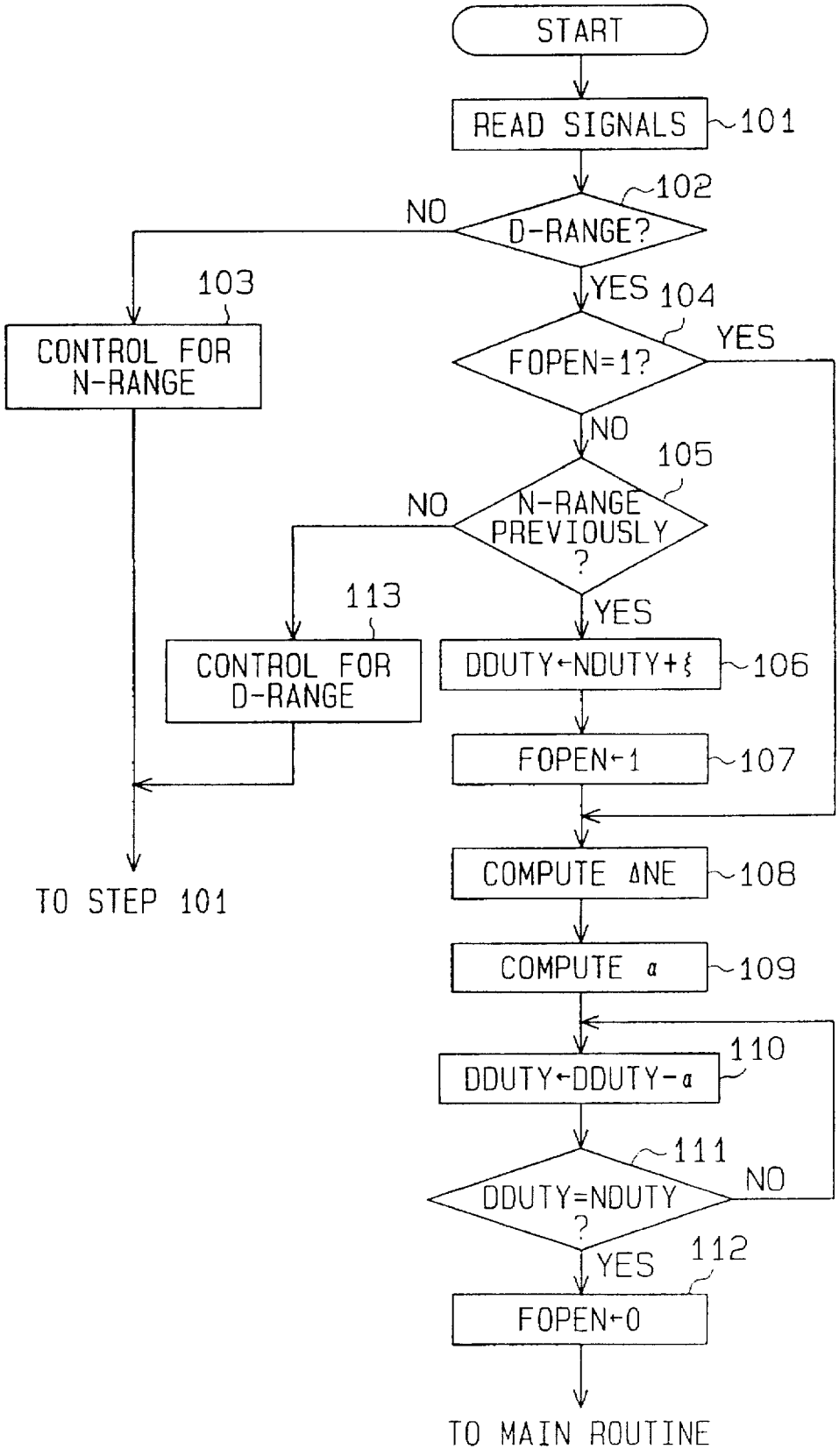
FIG. 4 is a flow-chart showing an ISCV control routine executed by an ECU according to the first embodiment of the present invention.
Figure 5:
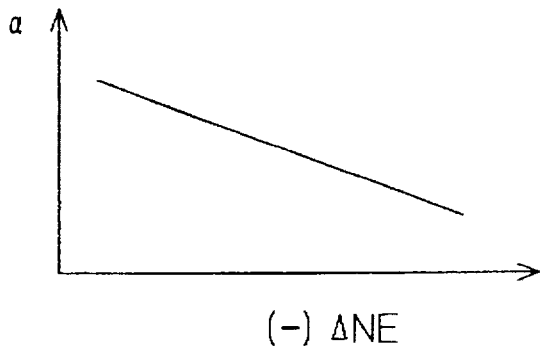
FIG. 5 is a map showing the relation between the rotation change rate and the factor of the attenuation rate.

A flow chart shown in FIG. 4 illustrates a subroutine of a control executed by the ECU 41.

In a step 101, the ECU 41 receives signals from the sensors 21 to 30 (for example the temperature of the airflow THA, the opening position of the throttle valve θ, the pressure of the aspirated air PiM, the oxygen content OX, the cooling water temperature THW, the engine speed NE, the speed of the automobile SPD, the shift lever position ShP and the air conditioner activate signal) and flags (for example an open loop control flag for idling FOPEN, which will be described later). In a subsequent step 102, the ECU 41 judges whether the current shift lever position ShP is in the drive range or not. If the position ShP is not in the drive range, i.e., if the lever is in the neutral range, the ECU 41 executes a feedback operation to control the ISCV 11, i.e., the speed of the engine 1 in the above described N-range mode.

If the lever is in the drive range, the ECU 41 judges, in a step 104, whether the open loop control flag FOPEN is "1" or not. If the flag FOPEN is "1", i.e., if the ECU 41 is in the switch mode, the ECU 41 goes to a step 108. If the flag FOPEN is "0", the ECU 41 goes to a step 105.

In the step 105, the ECU 41 judges whether the shift position ShP in the previous execution was in the neutral range or not. If the shift position ShP in the previous execution was in the neutral range, the ECU judges that shift position has been changed from the neutral range to the drive range in the current routine and goes into a step 106.

In the step 106, the ECU 41 adds a predetermined value ξ to the duty factor of the N-range NDUTY (corresponding to the target opening period of the ISCV 11) to obtain the duty factor for the D-range DDUTY. The ECU 41 then controls the opening of the ISCV 11 based on the D-range duty factor DDUTY. In a subsequent step 107, the ECU 41 sets the value of the flag FOPEN "1" to indicate the switch mode.

The ECU 41 goes to a step 108 from either the step 104 or the step 107 to compute the engine speed change rate ΔNE based on the difference between the engine speed NE read in the current execution and the engine speed NE read in the previous execution.

In a step 109, the ECU 41 determines an attenuation rate factor α based on the engine speed change rate ΔNE calculated in the current execution. The ECU 41 refers to a map shown in the FIG. 5 in order to determine the attenuation rate factor α. The change rate ΔNE is given in a negative number. The greater the absolute value of the change rate ΔNE is (the greater the decrease of the speed NE of the engine 1 is), the smaller the attenuation rate factor α becomes. On the other hand, the smaller the absolute value of the change rate ΔNE is (the smaller the decrease of the speed NE of the engine 1 is), the greater the attenuation rate factor α becomes.

In a step 110, the ECU 41 obtains a new duty factor for the D-range DDUTY by subtracting the attenuation rate factor α determined in the step 109 from the duty factor DDUTY obtained in the previous execution. The ECU 41 then controls the period of the opening of the ISCV 11 based on the newly obtained duty factor DDUTY.

In a step 111, the ECU 41 judges whether or not the current duty factor for the D-range DDUTY has decreased to be equal to the duty factor for the N-range NDUTY immediately before the shift lever S was switched to the drive range or not. If the result of the judging in the step 111 is "No", the ECU 41 goes back to the step 110 to repeat the above described subroutine. On the other hand, if the result of the judging is "Yes", the ECU 41 goes on to a step 112 to set the flag FOPEN "0" and temporarily stops the subroutine.

In the step 105, if the position ShP of the shift lever S of the previous execution was not in the neutral range, the ECU 41 judges that the switch mode has already been completed and that the shift lever S is continuously held in the drive range. Then the ECU 41 goes on to the step 113 to execute a feedback operation in order to control the speed of the engine 1 in the D-range mode.

Figure 6:
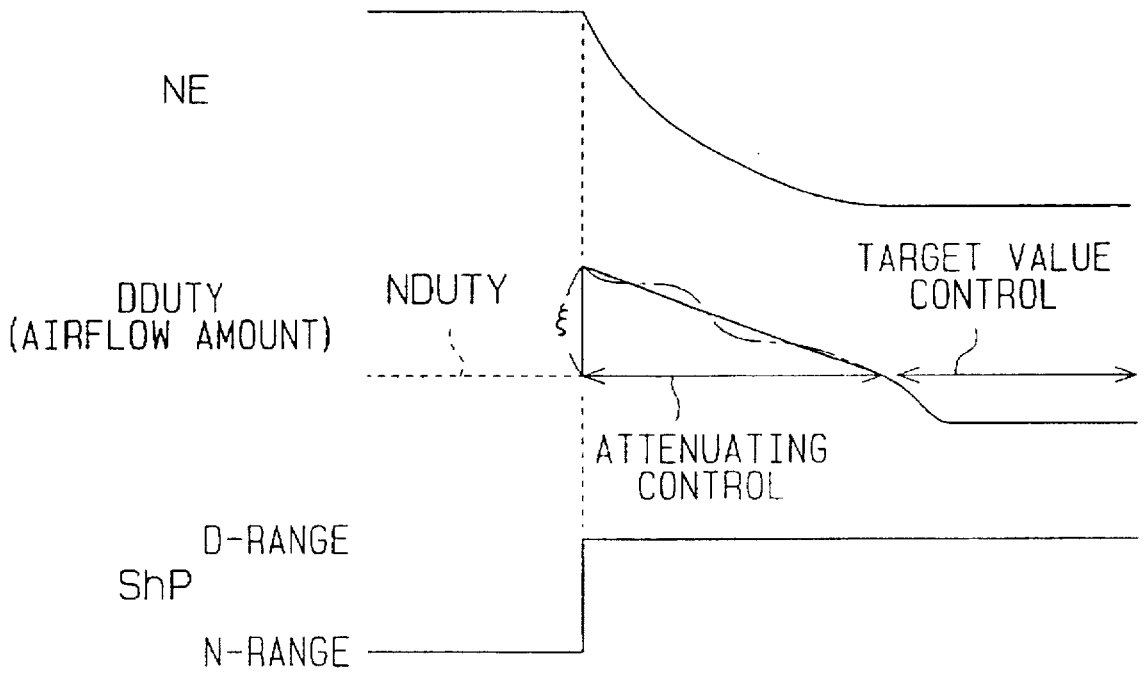
FIG. 6 is a timing chart for explaining the operation and the effect of the first and second embodiments.

In the above described routine, when the position ShP of the shift lever S is changed from the neutral range to the drive range, the ECU 41 obtains a new duty factor for the D-range DDUTY by adding the predetermined value ξ to the duty factor for the N-range NDUTY. The ECU 41 then controls the period of the opening of the ISCV 11 based on the newly obtained duty factor DDUTY. Accordingly, as shown in FIG. 6, the period of the opening of the ISCV 11 is increased by the predetermined value and an abrupt drop of the speed NE of the engine 1, which is caused by changing the shift lever position ShP into the drive range, is avoided.

Subsequently the attenuation rate factor α is set based on the change rate ΔNE of the speed of the engine 1. The duty factor for the D-range DDUTY is decreased gradually by the amount of the attenuation rate factor α. Accordingly the period of the opening of the ISCV 11 decreases gradually. The greater the decrease of the engine speed NE is, the smaller the attenuation rate factor α is set. On the contrary, the smaller the decrease of the engine speed NE is, the greater the attenuation rate factor α is set. In other words, a new duty factor for the D-range DDUTY is obtained by subtracting the attenuation rate factor α from the duty factor for the D-range DDUTY. The opening of the ISCV 11 is controlled based on the newly obtained duty factor for the D-range DDUTY.

The amount of the decrease of the engine speed NE may correspond to the expected decrease of the speed NE caused by the added load to the engine 1. In other words, when a possible decrease of the engine speed NE is great, the rate of change ΔNE of the speed naturally becomes great. As described above, the attenuation rate factor α is determined in connection with the decrease of the engine speed NE. Therefore, even if the load applied to different engines 1 varies, the rate of air is adjusted in accordance with the load applied to each engine 1. In other words, the amount of air is adjusted in accordance with the amount of the decrease of the engine speed NE. Also, even when the load applied to the engine 1 is great (for example when the oil temperature in the automatic transmission 15 is low and its viscosity is high), the amount of air is adjusted in accordance with the magnitude of the load.

Therefore, when changing the lever position ShP applies a load to the idling engine 1, an abrupt drop of the engine speed by the load is positively prevented. In other words, a smooth decrease of the engine speed NE corresponding to the change of the lever position ShP is realized.

(Second Embodiment)

The second embodiment of the present invention will now be described. The mechanical structure of the apparatus according to the second embodiment is the same with that of the first embodiment. Therefore only the control program, which is the different feature of this embodiment, will be described.

Figure 7:
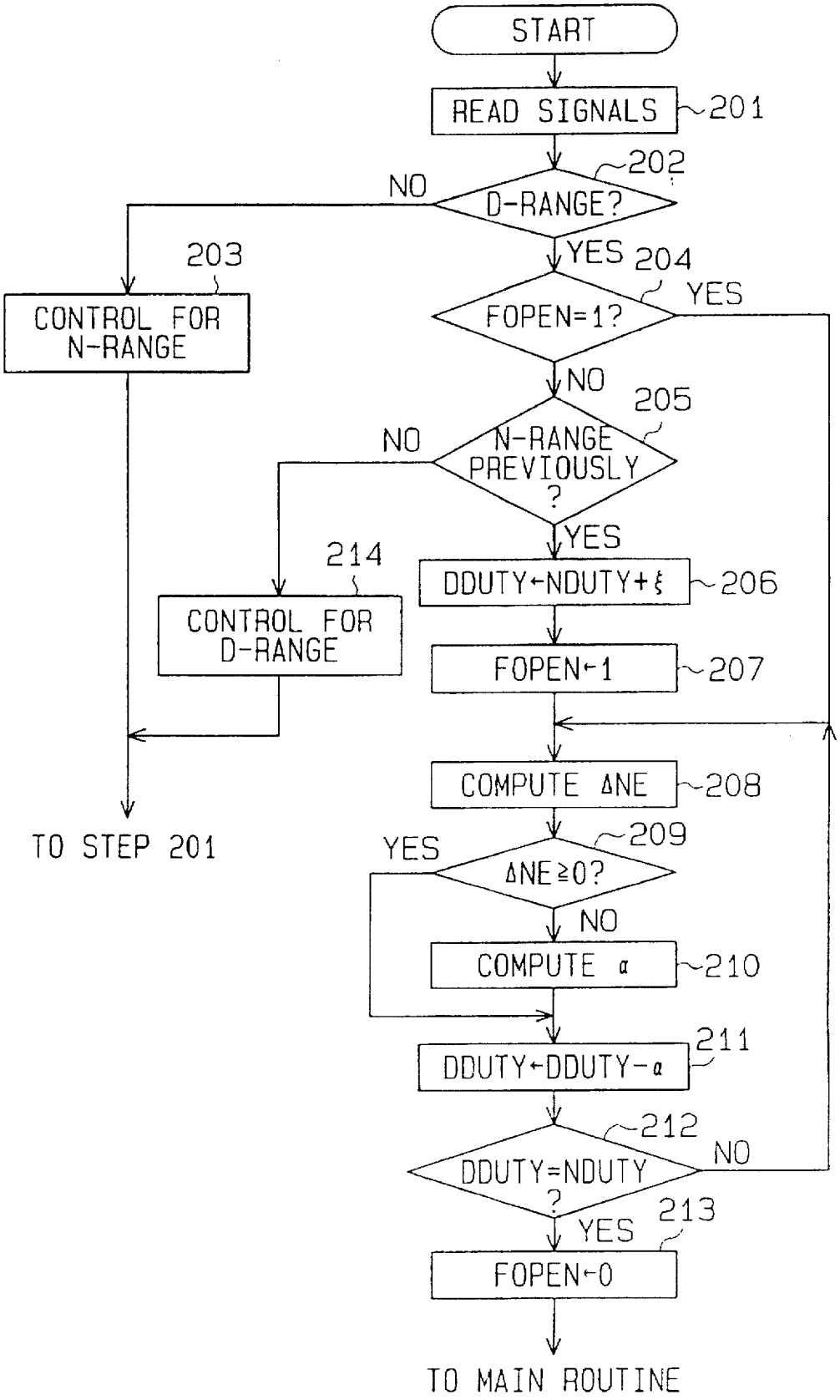
FIG. 7 is a flow-chart showing an ISCV control routine executed by an ECU according to the second embodiment of the present invention.

In the flow chart shown in FIG. 7, the ECU 41 executes steps 201 to 207. The processes executed in the steps 201 to 207 are the same as the processes executed in the steps 101 to 107 in the first embodiment.

Next, in a step 208, the ECU 41 calculates an engine speed change rate ΔNE based on the difference between the engine speed NE read in the previous execution and the engine speed NE read in the current execution.

In a step 209, the ECU 41 judges whether or not the engine speed change rate ΔNE calculated in the current routine is greater than or equal to zero. If the rate of change ΔNE is below "0", i.e. the engine speed NE has decreased, the ECU 41 moves on to a step 210 and, as in the step 109 in the first embodiment, calculates the attenuation rate factor α based on the speed change rate ΔNE determined in the current execution referring to the map shown in FIG. 5. Then the ECU 41 moves on to a step 211.

On the other hand, if the rate of change ΔNE calculated in the step 209 is greater than or equal to zero, i.e., if the engine speed NE has not decreased, the attenuation ratio factor α does not require renewal. The ECU 41 therefore skips the step 210 and moves on to a step 211. In the step 211, the ECU 41 obtains a new duty factor for the D-range DDUTY by subtracting either the new attenuation rate factor α calculated in the step 210, or the attenuation rate factor α that was not renewed, from the duty factor for the D-range DDUTY in the previous execution. The ISCV 11 is controlled based on the newly obtained duty factor for the D-range DDUTY.

In a step 212, the ECU 41 judges whether or not the current duty factor for the D-range DDUTY has decreased to be equal to the previous duty factor for the N-range NDUTY. If the result of the judging is "No", the ECU 41 goes back to the step 208, re-calculates the change rate ΔNE and repeats the processes of the steps 209 to 212 again. If the duty factor for the D-range DDUTY is equal to the duty factor for the N-range NDUTY in the step 212, the ECU 41 moves on to a step 213 and executes the same process as the first embodiment.

In the step 202, if the shift lever position ShP is not in the drive range, the ECU 41 executes the control for the N-range as in the first embodiment. In the step 205, if the shift lever position ShP is not in the neutral range, the ECU 41 executes the control for the D-range as in the first embodiment.

As described above, the second embodiment can be distinguished from the first embodiment by its calculation of the speed change rate ΔNE, which is executed every time the lever position ShP is changed from the N-range to the D-range. In other words, if the speed change rate ΔNE is negative, i.e., if the engine speed NE has decreased, the attenuation rate factor α is determined and renewed based on the speed change rate ΔNE at the moment as shown with alternate long and short dashes line in FIG. 6. Then the duty factor for the D-range DDUTY is calculated in accordance with the renewed attenuation rate factor α. This enables an accurate and smooth engine speed control in accordance with the change of the engine speed NE.

In this embodiment, when the engine speed change rate ΔNE is greater than or equal to zero, i.e., when the engine speed NE is temporarily increased, the ECU 41 neither determined nor renews the attenuation rate factor α. This prevents the attenuation rate factor α from being set small by an increase of the engine speed NE. Accordingly, the engine speed NE decreases to a predetermined value rapidly. This enables a smooth and quick control for decreasing the engine speed NE to the predetermined value when load is applied to the engine.

(Third Embodiment)

The third embodiment of the present invention will be now described. The attenuation rate factor α in this embodiment is determined based on change of the intake pressure while the attenuation rate factor α is determined based on change of the speed of the engine 1 in the first and second embodiments.

Figure 8:
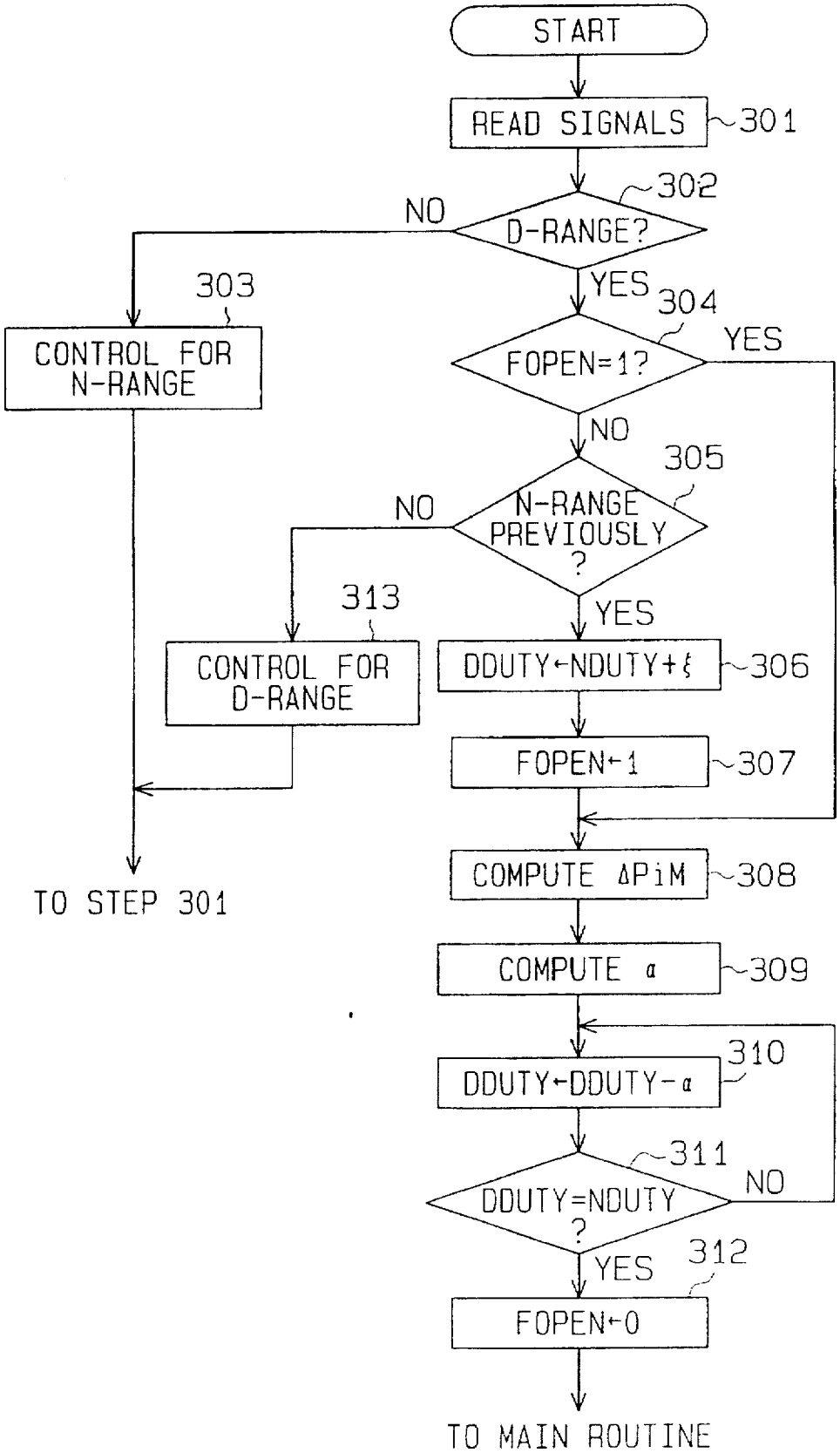
FIG. 8 is a flow-chart showing an ISCV control routine executed by an ECU according to the third embodiment of the present invention.

As shown in FIG. 8, in steps 301 to 307 and 310 to 313, the ECU 41 executes processes that are the same as the processes executed in the steps 101 to 107 and 110 to 113 in the first embodiment.

Figure 9:
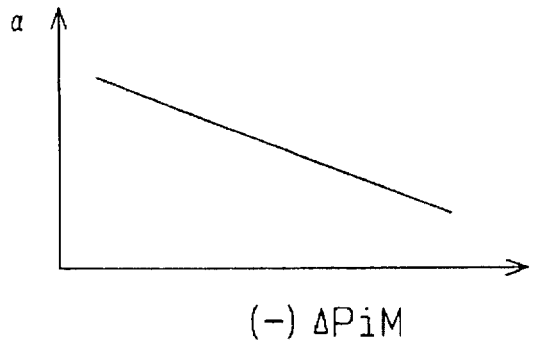
FIG. 9 is a map showing the relation between the intake pressure change rate and the attenuation rate.
Figure 10:
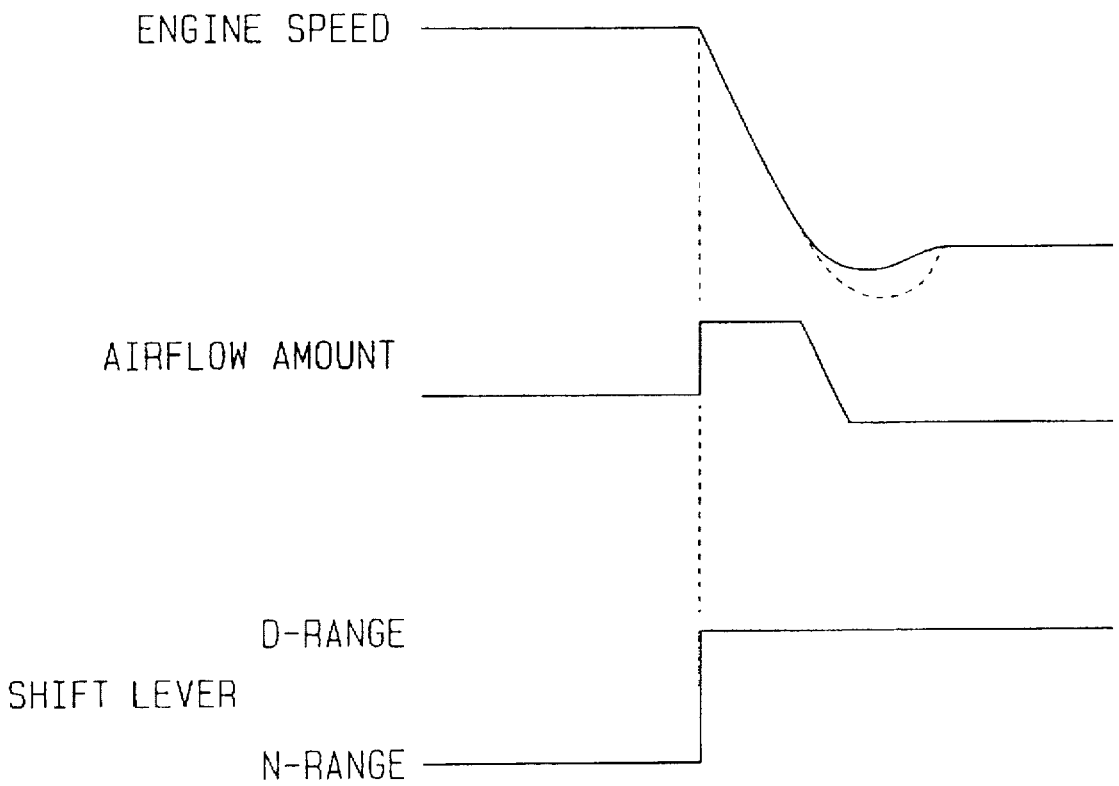
FIG.10 (PRIOR ART)
FIG. 10 is a timing chart for explaining operations, such as the speed of an engine, of the conventional engine.

The different feature of the third embodiment will be now described. In a step 308, the ECU 41 calculates the intake pressure change rate ΔPiM based on the difference between the intake pressure PiM read in the current routine and the intake pressure PiM read in the previous routine. In a step 309, the ECU 41 calculates the attenuation rate factor α based on the intake pressure change rate ΔPiM. The ECU 41 refers to a map shown in the FIG. 9 in order to determined the attenuation rate factor α. In the map, the greater the absolute value of the intake pressure change rate ΔPiM is (the greater the decrease of the intake pressure is), the smaller the attenuation rate factor α becomes. On the other hand, the smaller the absolute value of the intake pressure change rate ΔPiM is (the smaller the decrease of the intake pressure is), the greater the attenuation rate factor α becomes.

In a step 310, the ECU 41 obtains a new duty factor for the D-range DDUTY by subtracting the attenuation rate factor α calculated in the step 309 from the duty factor DDUTY calculated in the previous routine. The ECU 41 then controls the period of the opening of the ISCV 11 based on the newly obtained duty factor DDUTY.

Just as with the engine speed change rate ΔNE, the intake pressure change rate ΔPiM will correspond to the expected decrease of the speed NE caused by the added load to the engine 1. In other words, when the decrease of the engine speed NE is great, the intake pressure change rate ΔPiM naturally becomes great. Therefore the same effect as the first embodiment is obtained by this embodiment.

Further, the intake pressure change rate ΔPiM may used as a parameter for the air-fuel ratio control, the ignition timing control and other controls. In this case, the intake pressure change rate ΔPiM may be used as a common parameter for the engine speed control of this embodiment and the other controls. Accordingly, the engine speed control, together with other controls, realizes a minute and smooth engine control.

Although only three embodiments of the present invention have been described herein, it should be apparent those skilled in the art that the present invention may be embodied in many other specific forms without departing from the spirit or scope of the invention. Particularly, the invention may be embodied in the following forms:

(1) In the above described embodiments, a change of the shift lever position ShP is given as a cause of the load applied to the engine. However, the concept of the above described embodiments is applicable to cases in which accessories such as the conditioner or the head lights are turned on and apply load to the engine.

(2) The above described embodiments of the present invention are designed to work in a gasoline engine. However, the present invention is also applicable to a diesel engine.

(3) Instead of the the ISCV 11 used in the above described embodiments, a throttle valve having a step motor can be used to control the flow amount of air to the engine. In this case, the throttle valve is used for controlling the airflow when the engine is running as well as idling as described in U.S. Pat. No. 4,638,778 issued to Kamei on Jan. 27, 1987, which is incorporated herein by reference. The ECU acutuates the step motor to control the size of the opening of the throttle valve. This permits omission of the bypass and ISCV disposed therein, resulting in a simplified manufacturing process and thus a reduction of the manufacturing cost.

(4) The idle speed may be controlled by increasing and decreasing the amount of the fuel injection.

Therefore, the present examples and embodiments are to be considered as illustrative and not restrictive and the invention is not to be limited to the details given herein, but may be modified within the scope of the appended claims.

What is claimed is:

1. An apparatus for controlling the speed of an engine, wherein airflow is supplied to the engine through an air passage means, said apparatus comprising:

valve means located in the air passage means to control the airflow to the engine;

detecting means for detecting an engine condition;

control means for controlling the airflow amount through the valve means, said control means including computing means for computing a target airflow amount of the valve means based on the detected engine condition and determining means for determining an application of a load to the engine in accordance with a detected load;

said control means being arranged to operate according to at least a first mode and a second mode, said first mode being selected when the engine is running, said second mode being selected when the engine is idling;

said first mode being programmed to converge the airflow amount through the valve means to the target airflow amount; and said second mode being programmed to increase the airflow amount through the control valve to a predetermined degree based on the application of the load to the engine, said increased amount of the airflow being attenuated to a predetermined magnitude at a rate that is determined based on a rate of change of the engine speed.

2. The apparatus as set forth in claim 1, wherein said air passage means includes an air intake passage for introducing the air to the engine, and wherein said valve means includes a throttle valve located in the air intake passage to control the airflow to the engine.

3. The apparatus as set forth in claim 2, wherein said air passage means includes an idle passage having two ends respectively connected downstream and upstream of the throttle valve, and wherein said valve means includes an idle speed control valve located in the idle passage to control the airflow to the engine when the engine is idling.

4. The apparatus as set forth in claim 3, wherein said determining means further determines a removal of the load from the engine to cause the control means to change to the second mode.

5. The apparatus as set forth in claim 4, wherein said detecting means includes at least one of a sensor for detecting the engine speed, and a sensor for detecting pressure in the air intake passage which is substantially indicative of the engine speed.

6. The apparatus as set forth in claim 5 further comprising mapping means for providing a set of attenuation factors based on the change rate of the engine speed, said attenuation factors being used by the control means for said attenuation.

7. The apparatus as set forth in claim 6, wherein said attenuation factors increase in inverse proportion to a decreased amount of engine speed.

8. The apparatus as set forth claim 7, wherein said idle speed control valve is arranged to be digitally controllable by the control means.

9. The apparatus as set forth in claim 8 further comprising a solenoid for actuating the idle speed control valve, wherein said control means is arranged to compute a duty factor based on the engine speed to selectively activate and deactivate the solenoid in accordance with the computed duty factor.

10. The apparatus as set forth in claim 9, wherein said control means controls the control valve with an increased duty factor when the application of the load is detected.

11. The apparatus as set forth in claim 10, wherein said control means periodically executes a routine which is capable of repeated executions according to the second mode, wherein said determining means determines the increase of the load applied to the engine in the current execution with respect to the previous execution, and wherein said control means computes a difference in the engine speed between the current execution and the previous execution to judge the change rate of the engine speed.

12. An apparatus for controlling the speed of an engine, wherein airflow supplied to the engine through an air intake passage is controlled by adjusting a throttle valve located in the air intake passage, and wherein the throttle valve is substantially closed to restrict the airflow to the engine when the engine is idling, said apparatus comprising:

an idle passage communicating with the intake passage, said idle passage having two ends respectively connected downstream and upstream of the throttle valve;

an actuated control valve located in the idle passage, said control valve being arranged to control the airflow to the engine when the engine is idling;

detecting means for detecting an engine condition and;

determining means for determining increase of a load in accordance with a detected load;

mapping means for providing an attenuation factor based on a change rate of the engine speed;

first computing means for computing a duty factor for the control valve based the engine condition; and control means for digitally controlling the control valve with the computed duty factor, said control means being arranged to increase the airflow amount through the control valve to a predetermined amount based on the increase of the load to the engine which is determined by the determining means, said increased airflow amount being subsequently decreased to a predetermined magnitude at a dropping rate determined by the attenuation factor.

13. The apparatus as set forth in claim 12, wherein said attenuation factor increases in inverse proportion to a decreased amount of engine speed.

14. The apparatus as set forth in claim 13 further comprising:

a second computing means for computing a target airflow amount of the control valve based on the detected engine condition; and actuating means for actuating the control valve with the duty factor so as to converge the airflow amount through the control valve to the target airflow amount.

15. The apparatus as set forth in claim 14, wherein said first detecting means includes at least one of a sensor for detecting the engine speed, and a sensor for detecting pressure in the air intake passage, which is substantially indicative of the engine speed.

16. The apparatus as set forth in claim 15, wherein said control valve includes a solenoid, and wherein said control means is arranged to selectively activate and deactivate the solenoid with the duty factor.

17. The apparatus as set forth in claim 16 further including:

a lever member having a position for loading and a position for unloading the engine;

said determining means including judging means for judging the position of the lever member and giving an indication of its judgement;

said computing means being adapted to correct the duty factor based on the indication from the judging means; and said control means being arranged to control the control valve with the corrected duty factor so as to increase the amount of the airflow through the control valve, said corrected duty factor being subsequently decreased to a predetermined minimum magnitude corresponding to an idling condition of the engine free of the load.

18. An apparatus for controlling the speed of an engine, wherein airflow supplied to the engine through an air intake passage is controlled by adjusting a throttle valve located in the air intake passage, and wherein the throttle valve is substantially closed to restrict the airflow to the engine when the engine is idling, said apparatus comprising:

an idle passage communicating with the intake passage, said idle passage having two ends respectively connected downstream and upstream of the throttle valve;

an idle speed control valve located in the idle passage, said control valve being subject to a duty control to control the airflow to the engine when the engine is idling;

detecting means for detecting an engine condition;

determining means for determining an increase of a load to the engine in accordance with a detected load;

first computing means for computing a duty factor for the control valve based on the engine condition;

second computing means for computing a target airflow amount of the control valve based on the detected engine condition;

mapping means for storing an attenuation rate based on a change rate of the engine speed; and control means for controlling the control valve with the computed duty factor, said control means being arranged to change the duty factor so as to increase the airflow amount through the control valve to a predetermined amount based on the increase of the load to the engine, said increased duty factor being attenuated with the attenuation rate, and wherein said duty factor is converged to a duty factor corresponding to the idling state of the engine when it is substantially free of load, at which time said control means controls the airflow amount through the control valve to achieve the target airflow amount computed by the second computing means.

19. The apparatus as set forth in claim 18, wherein said attenuation rate increases in inverse proportion to a decreased amount of engine speed.

20. The apparatus as set forth in claim 19, wherein said detecting means includes at least one of a sensor for detecting the engine speed, and a sensor for detecting pressure in the air intake passage which is substantially indicative of the engine speed.

21. The apparatus as set forth in claim 20 further including:

a lever member having a position for loading the engine, and a position for unloading the engine;

said determining means including judging means for judging the position of the lever member and giving an indication of its judgement;

said computing means being adapted to correct the duty factor based on the indication from the judging means; and said control means being arranged to control the control valve with the corrected duty factor so as to increase the amount of the airflow through the control valve, said corrected duty factor being subsequently decreased to a predetermined minimum magnitude corresponding to an idling condition of the engine free of the load.

22. The apparatus as set forth in claim 21 further comprising an electric control unit for forming said control means, said first computing means, said second computing means, said determining means and said mapping means.

23. A method for controlling an idling speed of an engine, wherein a digitally controlled idle valve controls airflow in an idle passage connected to an air intake passage, the idle passage being arranged to bypass a throttle valve located in the air intake passage, said method comprising steps of:

detecting an engine condition and an increase of load to the engine by sensor means;

computing a duty factor for the control valve based the engine condition and the increase of the load; and digitally controlling the control valve with the duty factor, wherein the airflow amount through the control valve is increased to a predetermined amount when the load applied to the engine, said increased airflow amount being corrected by a attenuation rate factor chosen based on a change rate of the engine speed.

24. The method as set forth in claim 23 further including steps of:

computing a target amount of the airflow through the control valve when the load is not applied to the engine; and controlling the control valve with a duty factor to converge the amount of the airflow therethrough to the target amount.

25. The method as set forth in claim 24, wherein said detecting step includes a step of detecting the speed of engine with an engine speed sensor.

26. The method as set forth in claim 25, wherein said detecting step includes a step of detecting pressure in the air intake passage, which is substantially indicative of the speed of the engine.

27. The method as set forth in claim 26, wherein the step of digitally controlling the control valve includes a feed back control, and controls the control valve with a periodically repeating control based on the increase of the load to the engine.

* * * * *

UNITED STATES PATENT AND TRADEMARK OFFICE

CERTIFICATE OF CORRECTION

PATENT NO. : 5,701,867

DATED : December 30, 1997

INVENTOR(S) : Kouichi MIZUTANI, et al.

It is certified that error appears in the above-indentified patent and that said Letters Patent is hereby corrected as shown below:

On the title page, in section [73], change "Jidoshi" to --Jidosha--.

Signed and Sealed this

Twenty-fourth Day of March, 1998

Bruce Lehman

*Attest:*

BRUCE LEHMAN

*Attesting Officer*

*Commissioner of Patents and Trademarks*